US009597564B2

(12) United States Patent
Zhang

(10) Patent No.: US 9,597,564 B2
(45) Date of Patent: Mar. 21, 2017

(54) GOLF BAG

(76) Inventor: Aiping Zhang, Dongguan (CN)

( * ) Notice: Subject to any disclaimer, the term of this patent is extended or adjusted under 35 U.S.C. 154(b) by 288 days.

(21) Appl. No.: 14/240,635

(22) PCT Filed: Apr. 5, 2012

(86) PCT No.: PCT/CN2012/000446

§ 371 (c)(1),
(2), (4) Date: May 6, 2014

(87) PCT Pub. No.: WO2013/060090

PCT Pub. Date: May 2, 2013

(65) Prior Publication Data

US 2014/0246345 A1 Sep. 4, 2014

(30) Foreign Application Priority Data

Oct. 25, 2011 (CN) ..... 2011 1 0327020

(51) Int. Cl.
*A63B 55/00* (2015.01)

(52) U.S. Cl.
CPC ..... *A63B 55/007* (2013.01); *A63B 55/00* (2013.01); *A63B 55/404* (2015.10); *A63B 2225/09* (2013.01)

(58) Field of Classification Search
CPC ..... A63B 55/007; A63B 55/404; A63B 55/00; A63B 2225/09
See application file for complete search history.

(56) References Cited

U.S. PATENT DOCUMENTS 672,143 A * 4/1901 Boughner ..... A45C 7/0031 190/104
764,144 A * 7/1904 McGowan ..... A45C 7/0031 16/235
968,633 A * 8/1910 Andrews ..... B65D 21/086 190/105
1,241,210 A * 9/1917 Harvey ..... A45C 7/0031 190/104
1,341,099 A * 5/1920 Abramson ..... A45C 7/0063 190/103
2,079,476 A * 5/1937 Wolff ..... A45C 3/00 190/105
2,509,195 A * 5/1950 Barron ..... A63B 55/404 206/315.4
4,441,734 A * 4/1984 Schlissel ..... B62B 1/12 220/485
5,054,426 A * 10/1991 Panarelli ..... A01K 1/03 119/473
2004/0232016 A1* 11/2004 Dietrich ..... A63B 55/404 206/315.3

* cited by examiner

*Primary Examiner* — Tri Mai
(74) *Attorney, Agent, or Firm* — Muncy, Geissler, Olds & Lowe, P.C.

(57) ABSTRACT

A golf bag comprises a bag body. A club protection cover capable of axially sliding along a golf bag mouth is disposed in the golf bag mouth at an upper end of the bag body. A slide mechanism is disposed inside the club protection cover. The club protection cover is connected in the golf bag mouth through the slide mechanism. The golf bag can prevent damage to the club, and extend the service life of the club.

3 Claims, 9 Drawing Sheets

GOLF BAG

BACKGROUND OF THE INVENTION

1. Field of the Invention

The present disclosure relates to golf equipment, particularly a golf bag with a hidden club protection cover and a slide structure.

2. Descriptions of the Related Art

Currently, a known golf bag is usually provided with a club protection device based on two types as follows: a soft club protection device comprises a lid which is manufactured of the golf bag's shell fabric, lifted for a club removed therefrom, and put back and linked with buttons during transportation or storage; a club protection device with a hard shell cover lid manufactured of PE-based molded plastic is connected to the golf bag with buttons and removed for takeout of a club by a user who needs to find a place to store the separated lid at a golf course. In addition, it is usual to discover appearance damages or scratches which are induced by collisions among clubs held in a soft club protection device during transportation and affect a club's service life.

SUMMARY OF THE INVENTION

The present disclosure is intended to provide a golf bag which can be conveniently and safely used, carried and transported with no lid removed.

The technical measures in the present disclosure are described as follows: a golf bag comprising a bag body, a club protection cover axially sliding along and disposed in a golf bag mouth at the upper end of the bag body, and a slide mechanism located inside the club protection cover in which the club protection cover through the slide mechanism is connected to the golf bag mouth.

The slide mechanism in the present disclosure consists of slide bars axially disposed in the golf bag mouth and slide tabs at the inner lower wall of the club protection cover: each of the slide bars comprises a groove and a stop block at the groove's top; each of the slide tabs has an I-shaped appearance and allows one end to be connected to the club protection cover and the other end to be inserted into the groove's lower end and slide vertically along the slide bar.

The slide bars in the present disclosure are connected to an upper retaining ring and a lower retaining ring for secure connection to the slide bars at their upper and lower ends, respectively: the upper retaining ring is flexibly held in the club protection cover and securely links a bag head frame which is fixed at the inner wall of the upper retaining ring and comprises grids distributed inside.

The upper retaining ring, the lower retaining ring and the slide bars in the present disclosure are externally covered by a hollow plastic drum; the lower retaining ring is fixed on the inner wall of the hollow plastic drum; the upper retaining ring and the plastic drum allow the club protection cover to be held in between.

The number of slide bars in the present disclosure is from 2 to 4.

The slide mechanism in the present disclosure consists of slide bars axially disposed in the golf bag mouth and slide bushings installed in the club protection cover: each of the slide bushing is held in the slide bar; the slide bars are securely connected to a bag head frame atop; the bag head frame is installed in the club protection cover and comprises grids distributed inside.

The slide bars in the present disclosure are securely connected to a base of the bag body underneath: the base comprises ports inserted by the slide bars' lower ends from below.

The number of slide bars in the present disclosure is from 2 to 4.

The slide mechanism in the present disclosure consists of a hollow plastic drum disposed in the golf bag mouth and a club protection cover inside the plastic drum: the club protection cover is provided with a first rib around the lower outer circumference; the plastic drum is provided with a second rib around the upper inner circumference; the club protection cover is provided with a bag head frame at the central section; the bag head frame comprises grids distributed inside.

The club protection cover in the present disclosure is provided with a lid atop which is opened upward and links the club protection cover with a zipper.

In contrast to the current art, the golf bag in the present disclosure features a club protection cover sliding inside a bag body. A user lifting a lid on the club protection cover and allowing the club protection cover to slide downward can take a club away; a user removing the club protection cover from the bag body and closing the lid can protectively conceal used clubs in the golf bag, prevent clubs from damages or scratches during transportation or storage, and extend service lives of clubs without any club lost.

BRIEF DESCRIPTION OF THE DRAWINGS

FIG. 4-1 is schematic view illustrating a slide tab's structure in the first embodiment.

FIG. 4-2 is a sectional view of a slide bar in the first embodiment.

DETAILED DESCRIPTION OF THE PREFERRED EMBODIMENTS

The detailed technical measures of the present disclosure are described in embodiments hereinafter.

Figure 1:
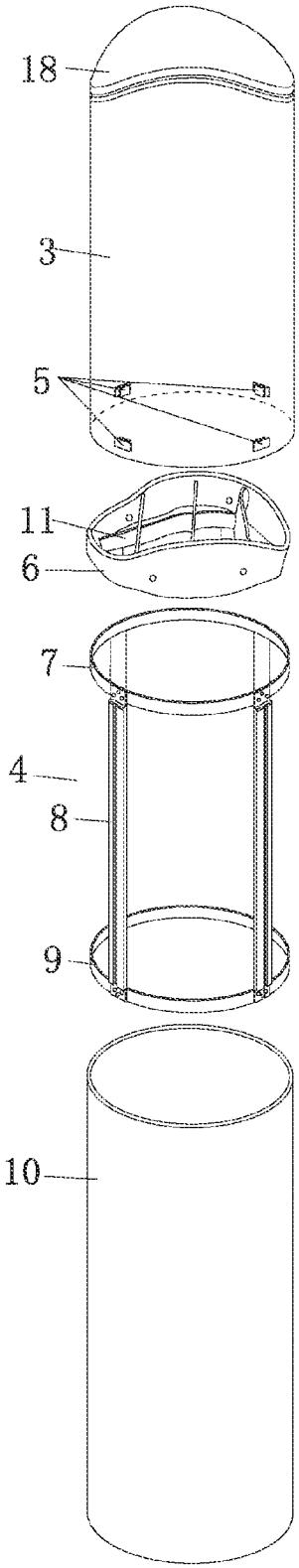
FIG. 1 is a perspective exploded view illustrating a golf bag of the present disclosure in the first embodiment.
Figure 2:
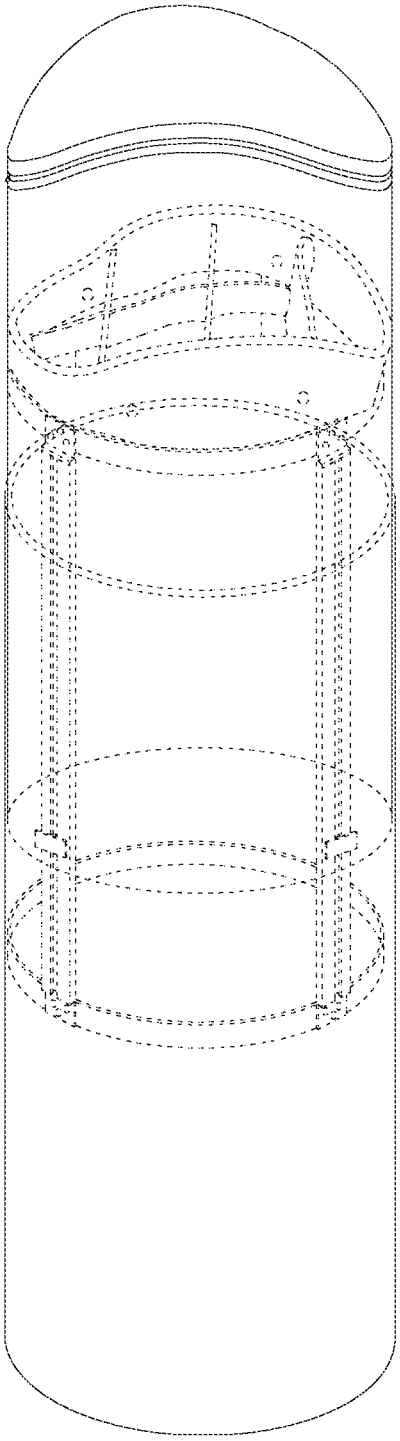
FIG. 2 is a perspective view illustrating a golf bag of the present disclosure in the first embodiment.
Figure 10:
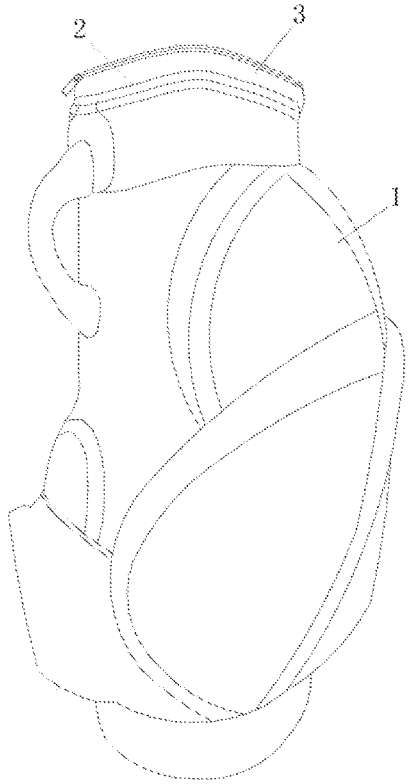
FIG. 10 is a schematic view illustrating a golf bag with clubs held.

As shown in FIGS. 1, 2 and 10, a golf bag of the present disclosure in the first embodiment comprises: a bag body 1; a club protection cover 3 which develops a cylinder and axially slides along and is disposed in a golf bag mouth 2 at the upper end of the bag body 1; a lid 18 installed above the club protection cover 3 and linking the club protection cover 3 with a zipper; a slide mechanism 4 located inside the club protection cover 3 in which the club protection cover 3 through the slide mechanism 4 is disposed and consisting of slide bars 8 axially installed inside the golf bag mouth 2, slide tabs 5 at the inner lower wall of the club protection cover 3, and an upper retaining ring 7 and a lower retaining ring 9 atop and underneath the slide bars 8, respectively. Each of the four slide bars 8 symmetrically arranged and separated by 90 degrees comprises a groove 81 with an opening at the bottom of the slide bar 8 and a stop block 82 atop the groove 81; each of the four slide tabs 5 situated at one side of the club protection cover 3 and coordinating the corresponding slide bars 8 for installation has an I-shaped appearance comprising a minor horizontal member, which is less than a major one in length and inserted into the groove 81 from below for sliding vertically along the slide bar 8, and a major member fixed on the club protection cover 3 which relies on the slide tabs 5 to slide vertically along the slide bars 8. The upper retaining ring 7 is flexibly held in the club protection cover 3 which is externally covered by a removable hollow plastic drum 10; the lower retaining ring 9 is internally fixed on the plastic drum 10; the upper retaining ring 7 links a bag head frame 6 which is fixed at the inner wall of the upper retaining ring 7 with rivets and integrated with the slide mechanism 4; the bag head frame 6 held in the club protection cover 3 comprises grids 11 distributed inside and keeps immobile (or develops a gap between the bag head frame 6 and the club protection cover 3) when the club protection cover 3 moves upward along the slide bars 8 (or downward until the upper edge of the lower retaining ring 9).

Figure 3:
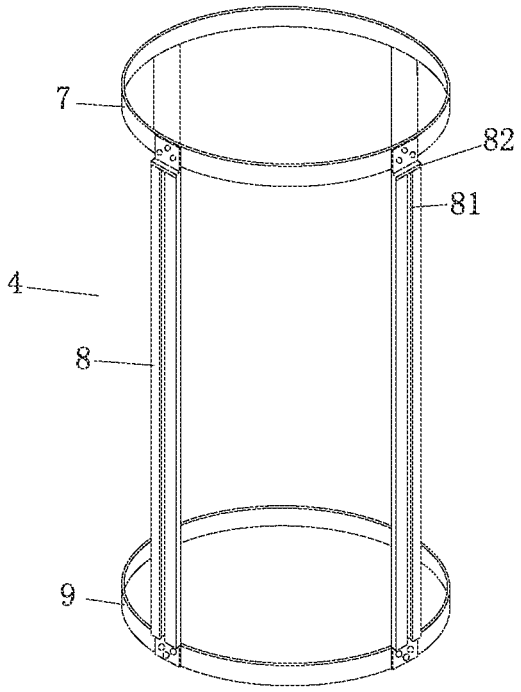
FIG. 3 is a schematic view which illustrates slide bars linking upper and lower retaining rings in the first embodiment.

As shown in FIG. 3, the slide mechanism 4 of the present disclosure in the first embodiment consists of the circular upper retaining ring 7, the circular lower retaining ring 9 and the laminar slide bars 8: the upper retaining ring 7 is securely connected to each of the slide bars 8 with three rivets atop; the lower retaining ring 9 is securely connected to each of the slide bars 8 with three rivets underneath; each of the slide bars 8 comprises a groove 81 with an opening which extends downward and is terminated by a stop block 82 atop the slide bar 8 in order to keep the slide tab 5 sustained by the groove 8.

Figures 1, 4:
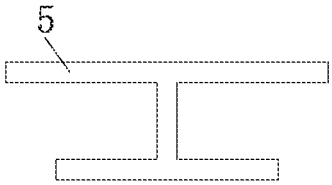
Figures 2, 4:
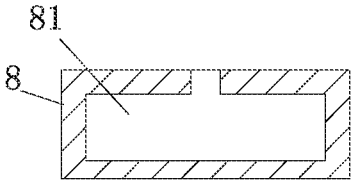

As shown in FIG. 4-1, the slide tab 5 of the present disclosure in the first embodiment has an I-shaped appearance comprising a minor horizontal member, which is less than a major one in length and inserted into the groove 81 from below for sliding vertically along the slide bar 8.

As shown in FIG. 4-2, the groove 81 of the slide bar 8 in the first embodiment develops a hollow rectangular structure which comprises a notch opened at the middle section of the groove 81 and accommodates the minor horizontal member sliding in the groove 81.

Figure 5:
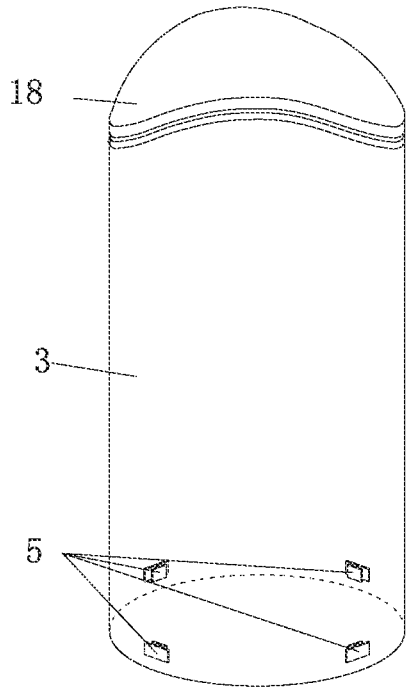
FIG. 5 is a schematic view illustrating a club protection cover of a golf bag in the first embodiment.

As shown in FIG. 5, the club protection cover 3 of a golf bag in the first embodiment is a cylinder developing an opening underneath and linking the lid 18 atop with zippers, rivets the slide tabs 5 which correspond to the slide bars 8 and are located at the inner lower wall near the opening and held in the slide bars 8, and relies on the slide tabs 5 to slide vertically along the slide bars 8.

The golf bag in the embodiment has three different specifications as follows:

Type I: club protection cover 3: height=480 MM, diameter=226 MM; slide tab 5 separated from the club protection cover's bottom by 30 mm; plastic drum 10: height=850 MM, diameter=239 MM; slide bar 8: length=520 MM, width=28 MM; slide tab 5: sliding distance=430 MM; upper retaining ring 7: diameter=220 MM, height=30 MM; lower retaining ring 9: diameter=220 MM, height=30 MM; slide tab: major horizontal member's length=45 MM, minor horizontal member's length=25 MM, length of a connecting piece between major and minor horizontal members=5 MM.

Type II: club protection cover 3: height=480 MM, diameter=213 MM; slide tab 5 separated from the club protection cover's bottom by 40 mm; plastic drum 10: height=850 MM, diameter=226 MM; slide bar 8: length=520 MM, width=28 MM; slide tab 5: sliding distance=430 MM; upper retaining ring 7: diameter=207 MM, height=30 MM; lower retaining ring 9: diameter=207 MM, height=30 MM; slide tab: major horizontal member's length=45 MM, minor horizontal member's length=25 MM, length of a connecting piece between major and minor horizontal members=5 MM.

Type III: club protection cover 3: height=480 MM, diameter=239 MM; slide tab 5 separated from the club protection cover's bottom by 40 mm; plastic drum 10: height=850 MM, diameter=251 MM; slide bar 8: length=520 MM, width=28 MM; slide tab 5: sliding distance=430 MM; upper retaining ring 7: diameter=232 MM, height=30 MM; lower retaining ring 9: diameter=232 MM, height=30 MM; slide tab: major horizontal member's length=45 MM, minor horizontal member's length=25 MM, length of a connecting piece between major and minor horizontal members=5 MM.

Figure 6:
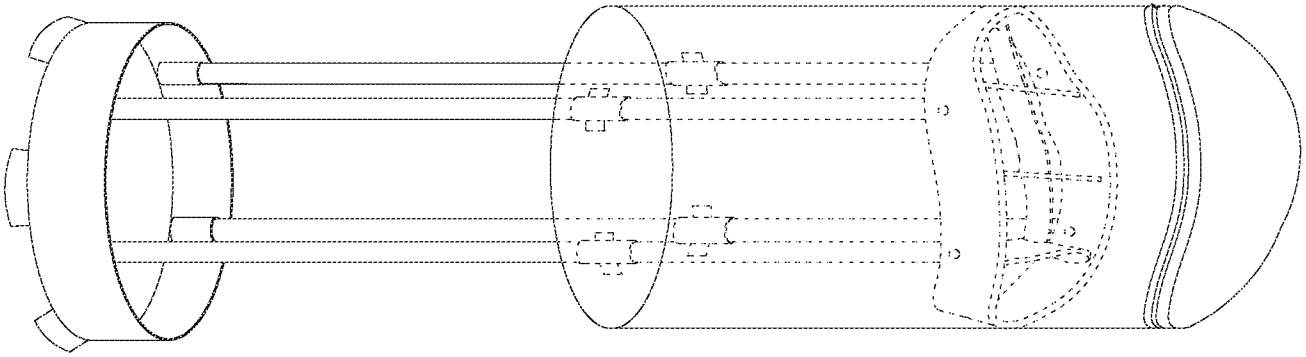
FIG. 6 is a perspective view illustrating a golf bag of the present disclosure in the second embodiment.
Figure 7:
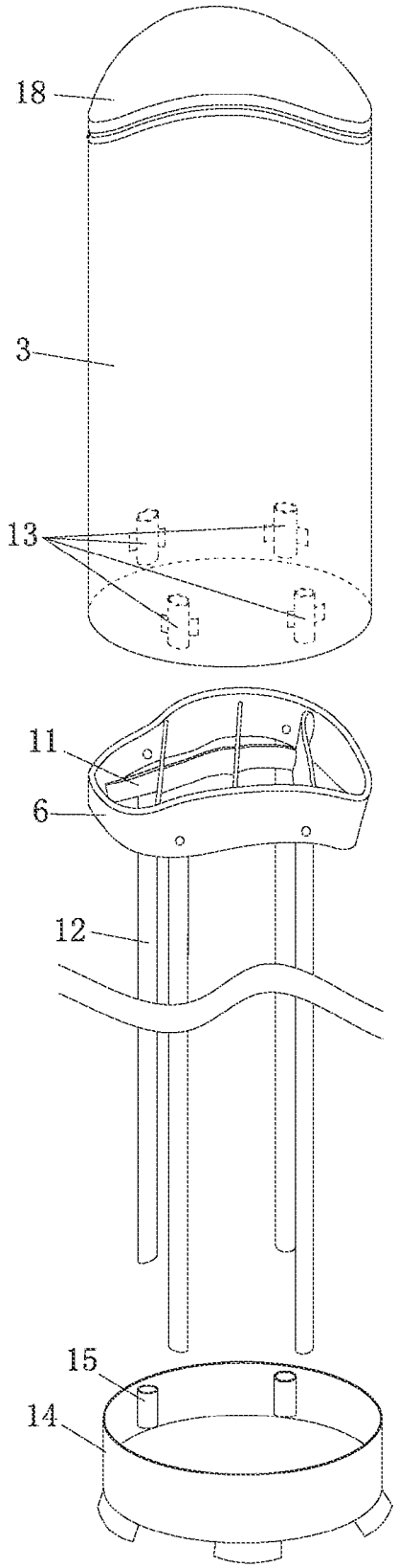
FIG. 7 is a perspective exploded view illustrating a golf bag of the present disclosure in the second embodiment.

As shown in FIGS. 6, 7 and 10, a golf bag of the present disclosure in the second embodiment comprises: a bag body 1; a club protection cover 3 which develops a cylinder and axially slides along and is disposed in a golf bag mouth 2 at the upper end of the bag body 1; a lid 18 installed above the club protection cover 3 and linking the club protection cover 3 with a zipper; a slide mechanism 4 located inside the club protection cover 3 and consisting of four slide bars 12, all of which are axially disposed in the golf bag mouth 2 and symmetrically arranged and separated by 90 degrees, and four slide bushings 13 connected to the inner lower wall of the club protection cover 3 and corresponding to and held in the slide bars 12; a bag head frame 6 located at tops of the slide bars 12, comprising ports through which the slide bars 12 are securely held with screws, and externally covered by the club protection cover 3; grids 11 distributed in the bag head frame 6; a base 14 situated at the bottom of the bag body 1 and developing ports 15 in which the ends of the slide bars 12 are securely inserted wherein each of the ports 15 is coupled with a screw to fix the slide bar 12 and keep the bag head frame 6 immobile with the club protection cover 3 shifted upward along the slide bar 12.

Figure 8:
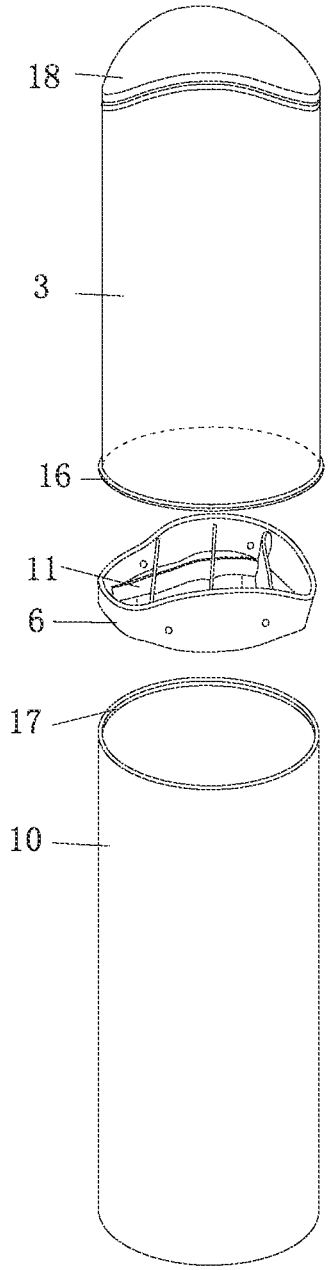
FIG. 8 is a perspective view illustrating a golf bag of the present disclosure in the third embodiment.
Figure 9:
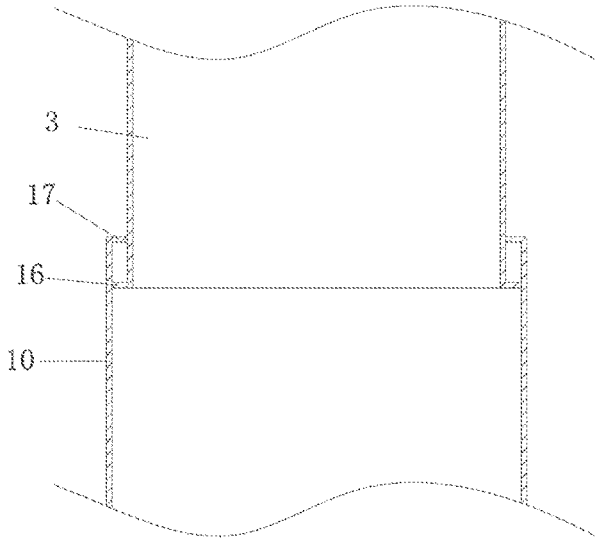
FIG. 9 is a sectional view illustrating a golf bag of the present disclosure in the third embodiment.

As shown in FIGS. 8, 9 and 10, a golf bag of the present disclosure in the third embodiment comprises: a bag body 1; a club protection cover 3 which develops a cylinder and axially slides along and is disposed in a golf bag mouth 2 at the upper end of the bag body 1; a lid 18 installed above the club protection cover 3 and linking the club protection cover 3 with a zipper; a slide mechanism consisting of a hollow plastic drum 10 disposed in the golf bag mouth 2 and a club protection cover 3 sliding inside the plastic drum 10; a first rib 16 around the lower outer circumference of the club protection cover 3; a second rib 17 around the upper outer circumference of the club protection cover 3; a bag head frame 6 at the central section inside the club protection cover 3; grids 11 distributed inside the bag head frame 6. As such, the upper surface of the first rib 16 contacts the lower surface of the second rib 17 and prevents the club protection cover 3 from not only upward movement but also separation from the plastic drum 10 as well as the golf bag mouth 2 when the club protection cover 3 is shifted to the top along the plastic drum 10.

As shown in FIG. 10, the club protection cover 3 is concealed by the golf bag mouth 2 with clubs held in a golf bag of the present disclosure.

Figure 11:
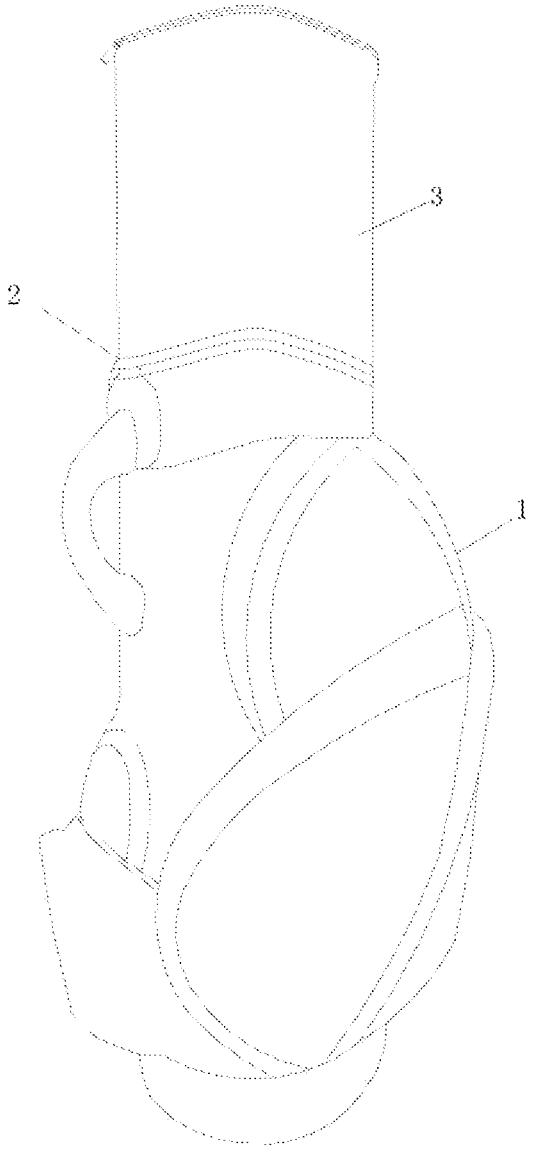
FIG. 11 is a schematic view illustrating a golf bag which has been transported or stored.

As shown in FIG. 11, a golf bag to be transported or stored is covered and protected by the lid 18 with a zipper when the club protection cover 3 is lifted from the golf bag mouth 2. The golf bag of the present disclosure with a club protection cover integrated is characteristic of clubs concealed in the golf bag sealed by a lid during transportation or storage with the club protection cover lifted and covering clubs. Moreover, the user-friendly golf bag allows clubs to be held inside the golf bag along slide bars with neither appearance nor functions affected when a club is taken through the opened lid.

What is claimed is:

1. A golf bag comprises a bag body, a club protection cover axially sliding along and disposed in a golf bag mouth at the upper end of the bag body, and a slide mechanism located inside the club protection cover in which the club protection cover through the slide mechanism is connected, the slide mechanism consisting of slide bars axially disposed in the golf bag mouth and slide bushings installed in the club protection cover: each of the slide bushings is held in the slide bar; the slide bars are securely connected to a bag head frame atop; the bag head frame is installed in the club protection cover and comprises grids distributed inside.

2. A golf bag according to claim 1 wherein the slide bars are securely connected to a base of the bag body underneath and the base comprises ports inserted by the slide bars from below.

3. A golf bag according to claim 2 wherein the number of slide bars is from 2 to 4.

* * * * *